US010087694B2

(12) United States Patent
Fernandes et al.

(10) Patent No.: US 10,087,694 B2
(45) Date of Patent: Oct. 2, 2018

(54) HANGER RUNNING TOOL

(71) Applicant: Cameron International Corporation, Houston, TX (US)

(72) Inventors: Edgar Fernandes, Stavanger (NO); Edward T. Thornburrow, Drighlington (GB)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 934 days.

(21) Appl. No.: 14/292,211

(22) Filed: May 30, 2014

(65) Prior Publication Data

US 2015/0345242 A1 Dec. 3, 2015

(51) Int. Cl.
*E21B 23/01* (2006.01)
*E21B 33/04* (2006.01)
*E21B 23/02* (2006.01)

(52) U.S. Cl.
CPC ..... *E21B 23/01* (2013.01); *E21B 23/02* (2013.01); *E21B 33/04* (2013.01)

(58) Field of Classification Search
CPC ..... E21B 23/01; E21B 23/02; E21B 33/04
See application file for complete search history.

(56) References Cited

U.S. PATENT DOCUMENTS 3,460,615 A * 8/1969 Watkins ..... E21B 33/04 166/208
3,688,841 A * 9/1972 Benton ..... E21B 33/047 166/89.2
4,545,434 A * 10/1985 Higgins ..... E21B 23/02 166/125
4,715,445 A * 12/1987 Smith, Jr. ..... E21B 31/20 166/217
5,439,061 A * 8/1995 Brammer ..... E21B 33/043 166/208
8,171,996 B2 * 5/2012 Jennings ..... E21B 33/04 166/208
8,627,895 B2 1/2014 Fern
2006/0011347 A1 * 1/2006 Reimert ..... E21B 33/043 166/345
2007/0007012 A1 * 1/2007 Bartlett ..... B24B 37/04 166/344
2008/0308278 A1 12/2008 Adamek et al.
2010/0155084 A1 * 6/2010 Watson ..... E21B 19/16 166/382
2011/0226487 A1 9/2011 Vanderford et al.
(Continued)

FOREIGN PATENT DOCUMENTS

EP 2357315 A1 8/2011
EP 2518260 A1 10/2012

OTHER PUBLICATIONS

International Search Report and Written Opinion Issued in PCT Application No. PCT/US2015/032834, dated Aug. 19, 2015 (18 Pages).

*Primary Examiner* — Blake E Michener
(74) *Attorney, Agent, or Firm* — Chamberlain Hrdlicka

(57) ABSTRACT

A hanger running tool for a hanger includes an outer sleeve and an inner driving sleeve. The outer sleeve is configured to engage and couple the hanger running tool to the hanger, and the inner driving sleeve is selectively axially movable within the outer sleeve for engagement with the hanger to prevent relative rotation between the hanger running tool and the hanger.

22 Claims, 10 Drawing Sheets

(56) References Cited

U.S. PATENT DOCUMENTS

| | | | | |
|---|---|---|---|---|
| 2011/0226490 | A1* | 9/2011 | Nguyen | E21B 33/035 166/382 |
| 2011/0240306 | A1* | 10/2011 | Neto | E21B 23/01 166/348 |
| 2012/0018171 | A1 | 1/2012 | Robottom | |
| 2012/0160511 | A1 | 6/2012 | Gette | |
| 2012/0305269 | A1 | 12/2012 | Bories | |
| 2013/0056282 | A1* | 3/2013 | Robottom | E21B 34/14 175/320 |
| 2014/0166298 | A1* | 6/2014 | Fenwick | E21B 23/00 166/360 |
| 2015/0152701 | A1* | 6/2015 | Levert, Jr. | E21B 33/04 166/380 |

* cited by examiner

HANGER RUNNING TOOL

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

In some drilling and production systems, hangers, such as a tubing hanger and/or a casing hanger, may be used to suspend strings (e.g., piping for various flows in and out of the well) of the well. Such hangers may be disposed within a spool of a wellhead that supports both the hanger and the string. For example, a hanger may be lowered into a spool by a drilling string. During the running or lowering process, the hanger may be latched to a hanger running tool, such as a tubing hanger running tool (THRT), thereby coupling the hanger to the drilling string. Once the hanger has been lowered into a landed position within the spool, the hanger may be locked into position. The hanger running tool may then be unlatched from the hanger and extracted from the wellhead by the drilling string.

BRIEF DESCRIPTION OF THE DRAWINGS

For a detailed description of embodiments of the subject disclosure, reference will now be made to the accompanying drawings in which.

DETAILED DESCRIPTION

Figure 1A:
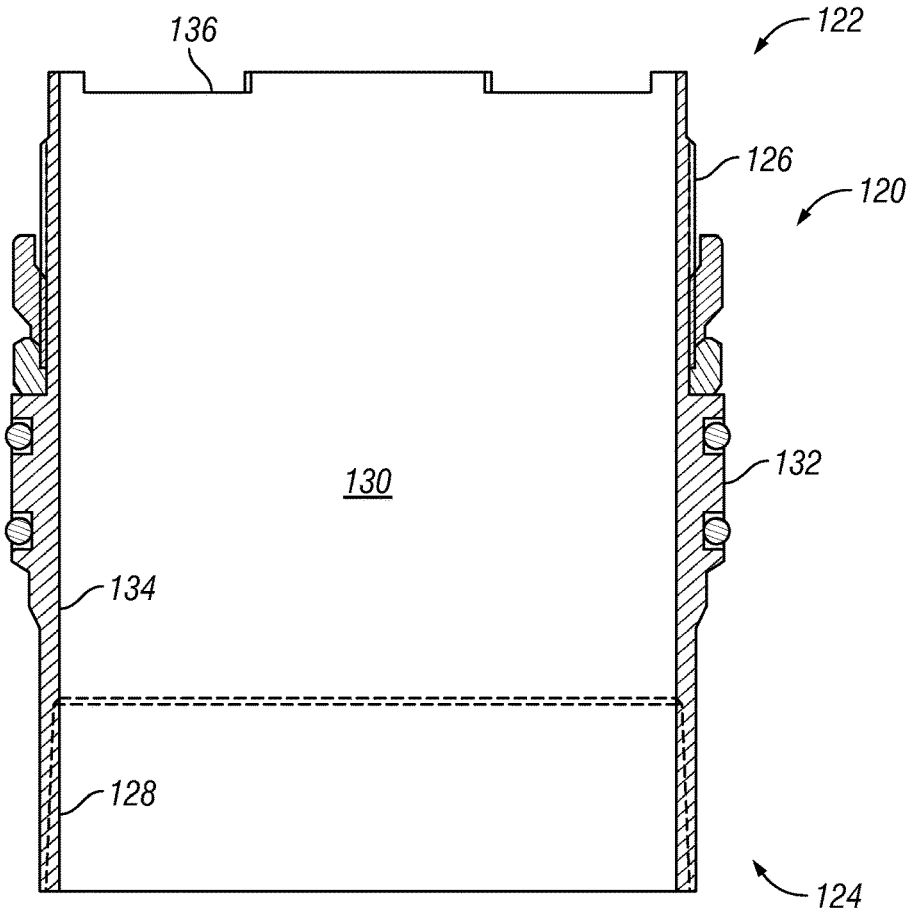
FIG. 1A shows a cross-sectional view of a hanger in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, disclosed herein are a hanger running tool and a system including a hanger running tool in accordance with one or more embodiments of the present disclosure. The hanger running tool may be used for connecting a hanger to a tubular string. As such, the hanger running tool may include an outer sleeve with an outer sleeve mating surface and an inner driving sleeve axially movable within the outer sleeve that includes an inner driving sleeve engagement surface. The outer sleeve mating surface is mateable with a hanger mating surface of the hanger to couple the outer sleeve to the hanger, and the inner driving sleeve engagement surface is selectively engageable with a hanger engagement surface of the hanger to rotate the hanger with the hanger running tool. Accordingly, the system may include the hanger with a hanger mating surface and a hanger engagement surface. The hanger may further include a second hanger mating surface that is mateable with a tubular string mating surface of the tubular string. In one or more embodiments, the hanger may be a casing hanger to support casing therefrom, may be a production hanger to support production tubing therefrom, and/or may be any other type of hanger known in the art. The hanger running tool may then, correspondingly, be used as a casing hanger running tool, tubing hanger running tool, and/or any other type of hanger running tool known in the art.

In one or more embodiments, the inner driving sleeve engagement surface may include a castellated surface, and the outer sleeve mating surface may include a threaded surface. As such, the hanger mating surface may include a corresponding threaded surface and the hanger engagement surface may include a corresponding castellated surface. The castellated surfaces of the inner driving sleeve engagement surface and/or the hanger engagement surface may include a plurality of castellations. As such, in one or more embodiments, one side of the plurality of castellations may include a tapered edge.

As the hanger may further include a second hanger mating surface to mate the hanger with the tubular string, the first hanger mating surface may include or be formed as a right-hand thread form or a left-hand thread form, in which the second hanger mating surface may include or be formed as the other of the right-hand thread form and the left-hand thread form. Engagement of the hanger engagement surface with the inner driving sleeve engagement surface may enable the hanger running tool to rotate the hanger such that the second hanger mating surface of the hanger mates with the tubular string without un-mating the first hanger mating surface with the outer sleeve mating surface. Engagement of the hanger engagement surface with the inner driving sleeve engagement surface may enable the hanger running tool to rotate the hanger in a first direction and disable or prevent the hanger running tool to rotate the hanger in a second direction.

Figure 1B:
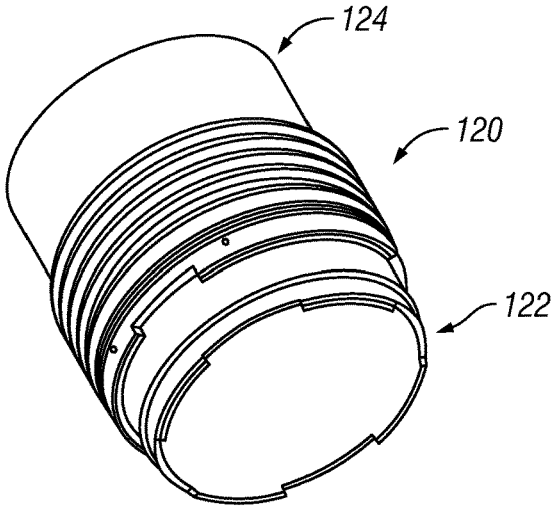
FIG. 1B shows a perspective view of the hanger in accordance with one or more embodiments of the present disclosure.

Referring now to FIGS. 1A and 1B, multiple views of a hanger 120 in accordance with one or more embodiments of the present disclosure are shown. A hanger running tool may be used to couple and connect to the hanger 120, such as when running and/or landing the hanger 120 within a well. The hanger 120 may then be used to support a tubular string therefrom, and a landing string may be connected to the hanger running tool to facilitate running the hanger 120 into a well with the hanger running tool. The hanger 120 may be landed and/or locked into a desired position within the well using the hanger running tool. In one or more embodiments, the tubular string, such as a casing string, supported by the hanger 120 may be cemented in place within the well. The hanger running tool may then be de-coupled or disconnected from the hanger 120 and retrieved from the well. As such, FIG. 1A shows a cross-sectional view of the hanger 120, and FIG. 1B shows a perspective view of the hanger 120.

The hanger 120 includes a first end 122 (i.e., an upper end), a second end 124 (i.e., a lower end), and a bore 130 formed therethrough about an axis. The first end 122 may include a first mating surface 126 formed on an external surface 132 of the hanger 120 and the second end 124 may include a second mating surface 128 formed on the internal surface 134 of the hanger 120. The first mating surface 126 may be used to mate the hanger 120 to a hanger running tool. Accordingly, the first mating surface 126 of the hanger 120 may be a threaded surface to threadedly engage with the second mating surface 108 of the hanger running tool, which may be a corresponding threaded surface.

Further, the second mating surface 128 of the hanger 120 may be used to mate the hanger 120 to a tubular string. Accordingly, the second mating surface 128 may be a threaded surface to threadedly engage with a corresponding mating surface on the tubular string. In one or more embodiments, as the first mating surface 126 and the second mating surface 128 of the hanger 120 may be threaded surfaces, the first hanger mating surface 126 may include or be formed as a right-hand thread form or a left-hand thread form, in which the second hanger mating surface 128 may include or be formed as the other of the right-hand thread form and the left-hand thread form. Therefore, in such an embodiment, the first mating surface 126 and the second mating surface 128 of the hanger 120 may have opposing thread forms. In one or more embodiments, the hanger 120 may also include an engagement surface 136, such as formed or included on the first end 122 of the hanger 120. In this embodiment, the engagement surface 136 may be a castellated surface that may include a plurality of castellations formed therein.

Figure 2A:
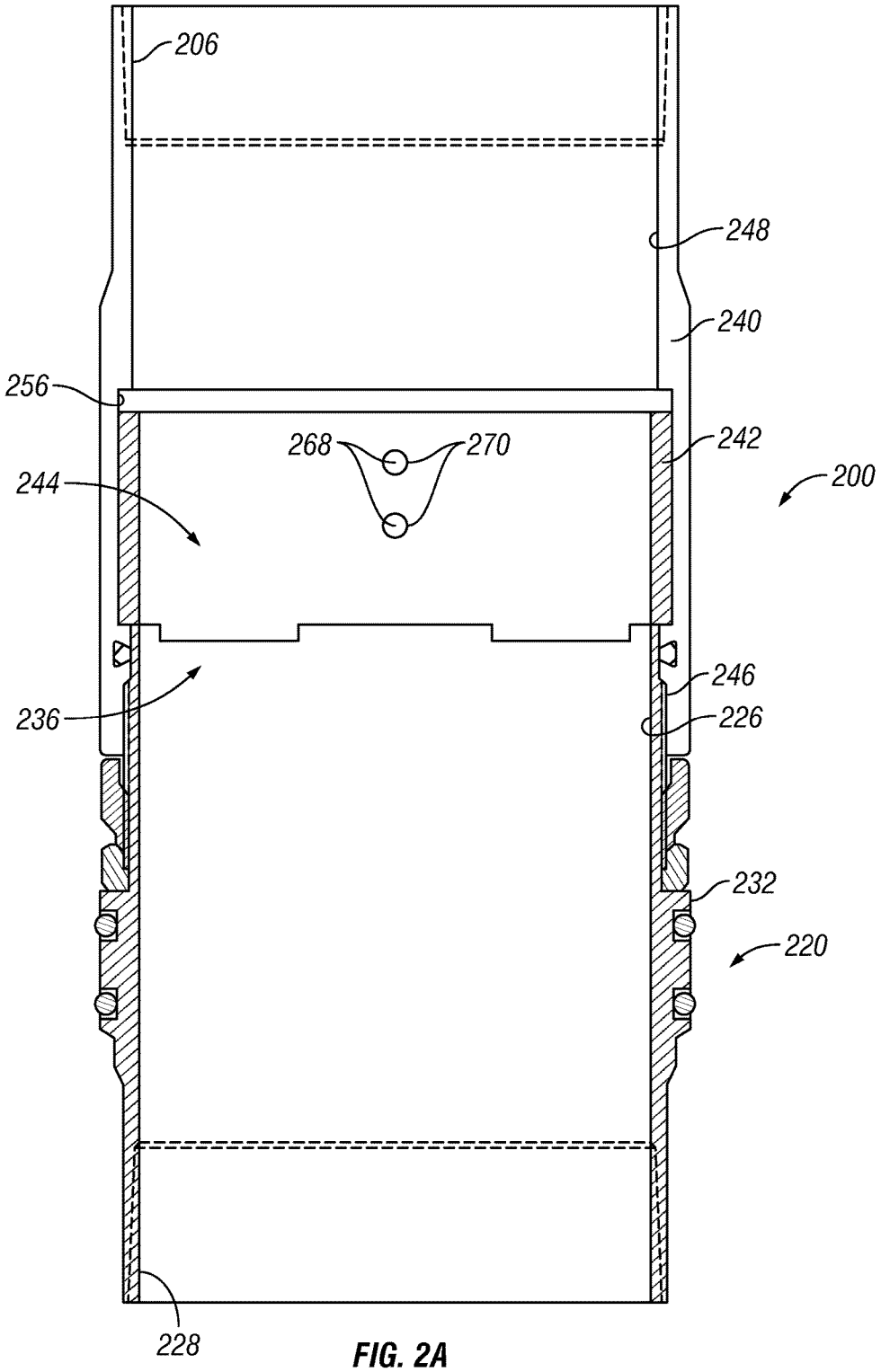
FIG. 2A shows a cross-sectional view of a hanger running tool and a hanger in an engaged position in accordance with one or more embodiments of the present disclosure.
Figure 2B:
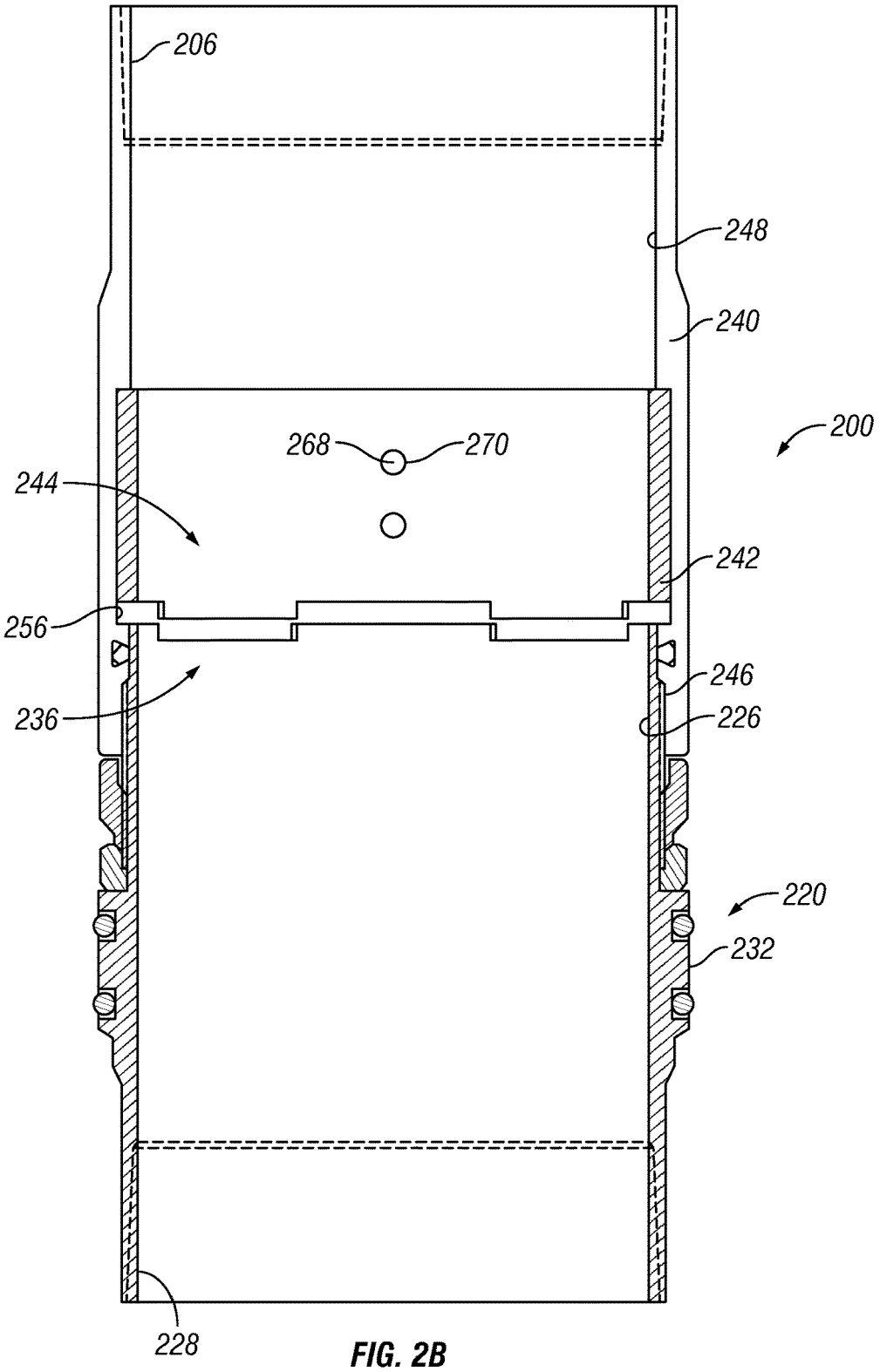
FIG. 2B shows a cross-sectional view of the hanger running tool and the hanger in a disengaged position in accordance with one or more embodiments of the present disclosure.
Figure 3:
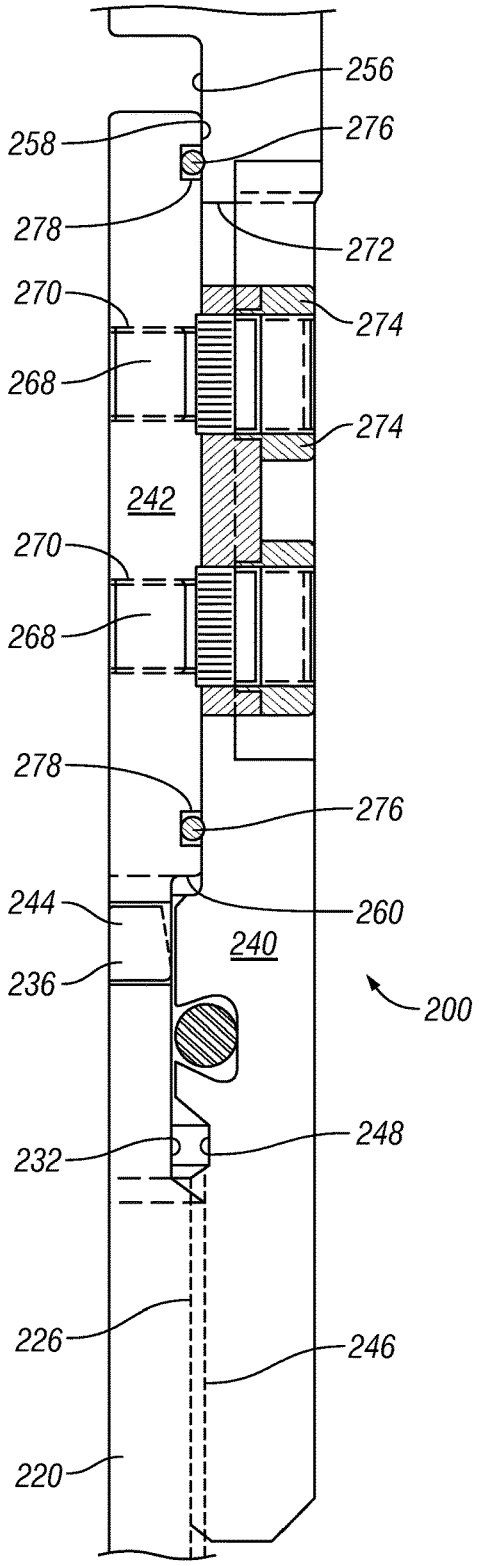
FIG. 3 shows a cross-sectional view of a hanger running tool and a hanger in accordance with one or more embodiments of the present disclosure.

Referring now to FIGS. 2A, 2B, and 3, multiple views of a hanger running tool 200 and a hanger 220 in accordance with one or more embodiments of the present disclosure are shown. Particularly, FIG. 2A shows a cross-sectional view of the hanger running tool 200 and the hanger 220 in an engaged position, FIG. 2B shows a cross-sectional view of the hanger running tool 200 and the hanger 220 in a disengaged position, and FIG. 3 shows a detailed cross-sectional view of the hanger running tool 200 and the hanger 220 in the engaged position. The hanger 220 may be similar to the hanger 120 shown in FIGS. 1A and 1B. Further, the hanger running tool 200 may include an outer sleeve 240 and an inner driving sleeve 242 axially movable with respect to the outer sleeve 240. The hanger running tool 200 may include an engagement surface 244, such as formed on a lower end of the inner driving sleeve 242, to selectively engage an engagement surface 236 of the hanger 220.

In one or more embodiments, when mating the hanger 220 to a tubular string, the hanger 220 may be rotated with respect to the tubular string to threadedly engage the mating surfaces between the hanger 220 and the tubular string. As such, the hanger running tool 200 may be rotated with the hanger 220 to rotate the hanger 220 with respect to the tubular string. In such an embodiment, the mating surface of the hanger 220 to threadedly engage with the hanger running tool 200 and the mating surface of the hanger 220 to threadedly engage with the tubular string may have opposing thread forms. This configuration may enable the hanger running tool 200 to rotate the hanger 220 in one direction to mate with the tubular string, but such rotation may also un-mate or disengage the hanger running tool 200 from the hanger 220. Accordingly, to facilitate mating the hanger running tool 200, the hanger 220, the tubular string supported by the hanger 220, and/or the landing string supporting the hanger running tool 200, the hanger running tool 200 may selectively engage the hanger 220, such as through engagement surfaces 236 and 244, to selectively prevent rotation between the hanger running tool 200 and the hanger 220.

As shown, in this embodiment, the outer sleeve 240 may include an outer sleeve mating surface 246 that may be used to mate with a hanger mating surface 226 of the hanger 220. The hanger mating surface 226 may be similar to the first mating surface 126 of the hanger 120 shown in FIGS. 1A and 1B, in which the mating surface 226 may be formed or included on an external surface 232 of the hanger 220. Further, the outer sleeve mating surface 246 may be formed or included on an internal surface 248 of the outer sleeve 240. Accordingly, the hanger mating surface 226 of the hanger 220 may be a threaded surface to threadedly engage with the outer sleeve mating surface 246 of the hanger running tool 200, which may be a corresponding threaded surface. The hanger running tool 200 may also include a mating surface 206, such as formed on the internal surface 248 of the outer sleeve 240. The mating surface 206 may be used to mate the hanger running tool 200 to a landing string. Accordingly, the mating surface 206 may be a threaded surface to threadedly engage with a corresponding mating surface on the landing string.

Further, in this embodiment, the inner driving sleeve 242 may include the inner driving sleeve engagement surface 244 that may be used to engage, such as selectively engage, with a hanger engagement surface 236 of the hanger 220. The hanger engagement surface 236 may be similar to the hanger engagement surface 136 of the hanger 120 shown in FIGS. 1A and 1B, in which the engagement surface 236 may be formed or included on an end of the hanger 220. Further, the inner driving sleeve engagement surface 244 may be formed or included on an end of the inner driving sleeve 242. The inner driving sleeve engagement surface 244 and the hanger engagement surface 236 may correspond with each other such that protrusions formed on one of the engagement surfaces correspond and complement with indentions formed on the other of the engagements surfaces. This configuration may enable rotation to be translated between the engagement surfaces when the engagement surfaces are engaged with each other. As such, in this embodiment, the hanger engagement surface 236 of the hanger 220 may be a castellated surface to engage with the inner driving sleeve mating surface 244 of the hanger running tool 200, which may be a corresponding castellated surface.

In one or more embodiments, the inner driving sleeve 242 may be axially movable with respect to, such as axially movable within, the outer sleeve 240. In particular, the inner driving sleeve 242 may be axially movable with respect to the outer sleeve 240 between an engaged position (e.g., a lower position), as shown particularly in FIG. 2A, and a disengaged position (e.g., an upper position), as shown particularly in FIG. 2B. In the engaged position, the inner driving sleeve engagement surface 244 may engage with the hanger engagement surface 236 of the hanger 220 such that rotation of the hanger running tool 200 may translate into rotation of the hanger 220, such as when rotating the hanger 220 with the hanger running tool 200. In the disengaged position, the inner driving sleeve engagement surface 244 may remain disengaged from the hanger engagement surface 236 of the hanger 200 such that rotation of the hanger running tool 200 does not translate into rotation of the hanger 220 through the engagement surfaces 236 and 244.

As discussed above, the hanger 220 may be used to mate to a tubular string. Accordingly, the hanger 220 may include a second hanger mating surface 228, similar to that shown in FIGS. 1A and 1B that may be used to mate, such as threadedly engage, with a corresponding mating surface on the tubular string. Accordingly, as the first hanger mating surface 226 and the second hanger mating surface of the hanger 220 may be threaded surfaces, the first hanger mating surface 226 may include or be formed as a right-hand thread form or a left-hand thread form, and the second hanger mating surface 228 may include or be formed as the other of the right-hand thread form and the left-hand thread form. Therefore, in such an embodiment, the first hanger mating surface 226 and the second hanger mating surface 228 of the hanger 220 may have opposing thread forms.

As discussed above, to facilitate mating the hanger running tool 200, the hanger 220, the tubular string supported by the hanger 220, and/or the landing string supporting the hanger running tool 200, the hanger running tool 200 may selectively engage the hanger 220 to selectively prevent rotation between the hanger running tool 200 and the hanger 220. For example, during use, when mating the hanger 220 to a tubular string to be supported by the hanger 220, the inner driving sleeve engagement surface 244 may engage with the hanger engagement surface 236 of the hanger 220, such as by moving the inner driving sleeve 242 to the engaged position with respect to the outer sleeve 240, such that rotation of the hanger running tool 200 may translate into rotation of the hanger 220. This configuration may enable the mating surfaces between the hanger 220 and the tubular string to mate and engage while also preventing the mating surfaces between the hanger 220 and the hanger running tool 200 to un-mate and disengage.

In an embodiment in which it is desired to un-mate and disengage the mating surfaces between the hanger 220 and the hanger running tool 200, the inner driving sleeve engagement surface 244 may disengage from the hanger engagement surface 236 of the hanger 220. For example, the inner driving sleeve 242 may be moved to the disengaged position with respect to the outer sleeve 240 such that rotation of the hanger running tool 200 does not translate into rotation of the hanger 220. This configuration may enable the mating surfaces between the hanger 220 and the hanger running tool 200 to un-mate and disengage, such as when retrieving the hanger running tool 200 from a well while leaving the hanger 220 with a tubing string set in the well.

In one or more embodiments, engagement of the hanger engagement surface 236 with the inner driving sleeve engagement surface 244 may enable the hanger running tool 200 to rotate the hanger 220 such that the second hanger mating surface of the hanger 220 mates with the tubular string without un-mating the first hanger mating surface 226 with the outer sleeve mating surface 246. Further, in one or more embodiments, engagement of the hanger engagement surface 236 with the inner driving sleeve engagement surface 244 may enable the hanger running tool 200 to rotate the hanger 220 in a first direction and may disable the hanger running tool 200 to rotate the hanger 220 in a second direction.

As discussed above, the hanger engagement surface 236 may include or be formed as a castellated surface, and the inner driving sleeve engagement surface 244 may include or be formed as a corresponding castellated surface. As such, when the castellated surfaces are engaged, rotation, such as in either a first direction and/or a second direction, may be imparted between the castellated surfaces. However, in one or more embodiments, the engagement surfaces and/or castellated surfaces may be formed such that rotation is imparted in only one direction, and not the other direction, between the surfaces.

Figure 4:
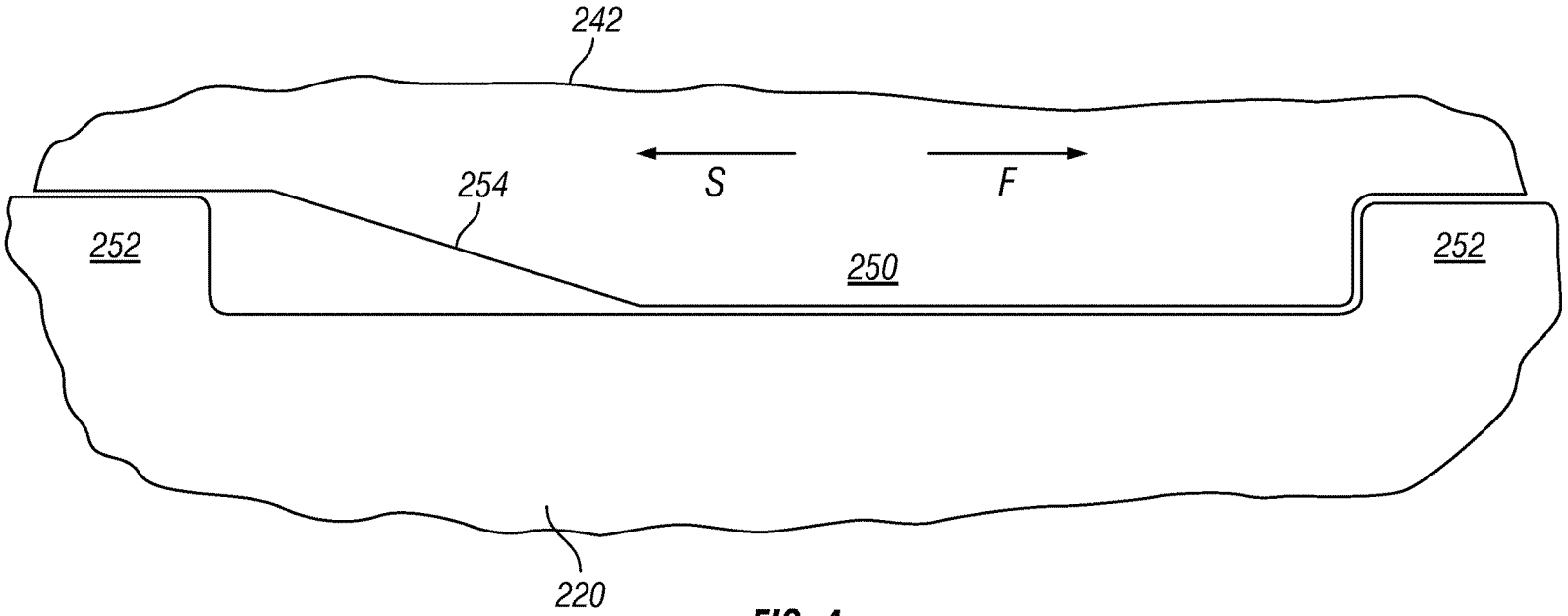
FIG. 4 shows a detailed view of a castellated surface of a hanger running tool and a castellated surface of a hanger in accordance with one or more embodiments of the present disclosure.

As shown in reference to FIG. 4, the castellated surface of the inner driving sleeve 242 may include one or more castellations 250 and the castellated surface of the hanger 220 may include one or more castellations 252. As such, in one or more embodiments, one side of the castellations 250 of the inner driving sleeve 242 may include or have formed thereon a tapered edge 254. In particular, the castellations 250 may each include a leading edge and a trailing edge, in which the trailing edge may be chamfered. By including a tapered edge 254 on the castellations 250, the castellated surface of the inner driving sleeve 242 may only impart rotation upon the castellated surface of the hanger 220 in a first direction F, whereas the tapered edge 254 may prevent the castellated surface of the inner driving sleeve 242 from imparting rotation upon the castellated surface of the hanger 220 in a second direction S.

For example, when the inner driving sleeve 242 is rotated in the first direction F (e.g., the right direction) with respect to the hanger 220, the leading edge of the castellation 250 of the inner driving sleeve 242 may engage the leading edge of the castellation 252 of the hanger 220, thereby enabling the inner driving sleeve 242 to impart rotation upon the hanger 220. However, when the inner driving sleeve 242 is rotated in the second direction S (e.g., the left direction) with respect to the hanger 220, the trailing edge of the castellation 250 of the inner driving sleeve 242 may be a tapered edge 254 such that the castellations 250 and 252 do not impart or translate rotation amongst each other. Instead, the tapered edge 254 is contacted and engaged by the castellation 252 to impart axial movement between the hanger 220 and the inner driving sleeve 242, such as to move the inner driving sleeve 242 from the engaged position to the disengaged position. As such, rotation in the second direction S may in fact move the inner driving sleeve 242 from the engaged position to the disengaged position with respect to the outer sleeve 200. Those having ordinary skill in the art will appreciate that, in addition or in alternative to the inner driving sleeve, the castellated surface of the hanger 220 may include tapered or chamfered edges for desired engagement between the engagement surfaces 236 and 244.

In one or more embodiments, the outer sleeve 240 and the inner driving sleeve 242 may include a groove and a projected surface formed therebetween, such as to facilitate movement between the outer sleeve 240 and the inner driving sleeve 242. For example, in FIG. 3, the outer sleeve 240 may include a groove 256 formed on the internal surface 248 of the outer sleeve 240, and the inner driving sleeve 242 may include a projected surface 258 formed on an outer surface 260 of the inner driving sleeve 242. The projected surface 258 of the inner driving sleeve 242 may be engageable with and/or axially movable within the groove 256, such as movable between the engaged position (e.g., lower position), as shown, and the disengaged position (e.g., upper position).

Figure 5:
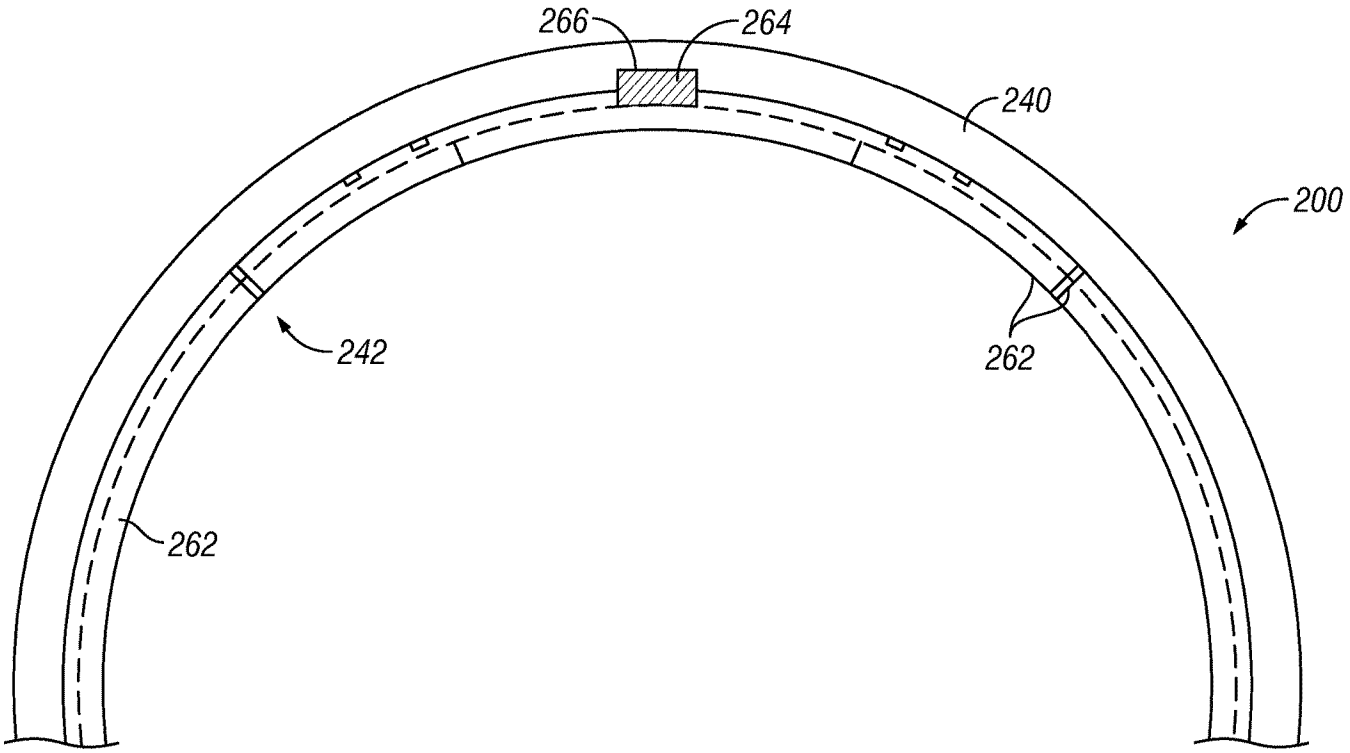
FIG. 5 shows a cross-sectional axial view of a hanger running tool in accordance with one or more embodiments of the present disclosure.

In one or more embodiments, the inner driving sleeve 242 may be formed as or include a plurality of segments 262. For example, to include a projected surface received within a groove between the outer sleeve 240 and the inner driving sleeve 242, one of the outer sleeve 240 and the inner driving sleeve 242 may be formed as or include a plurality of segments. Accordingly, as shown in FIG. 5, the inner driving sleeve 242 may include the plurality of segments 262. In this embodiment, the inner driving sleeve 242 may be formed to include four segments 262, though the present disclosure is not so limited.

Figure 6:
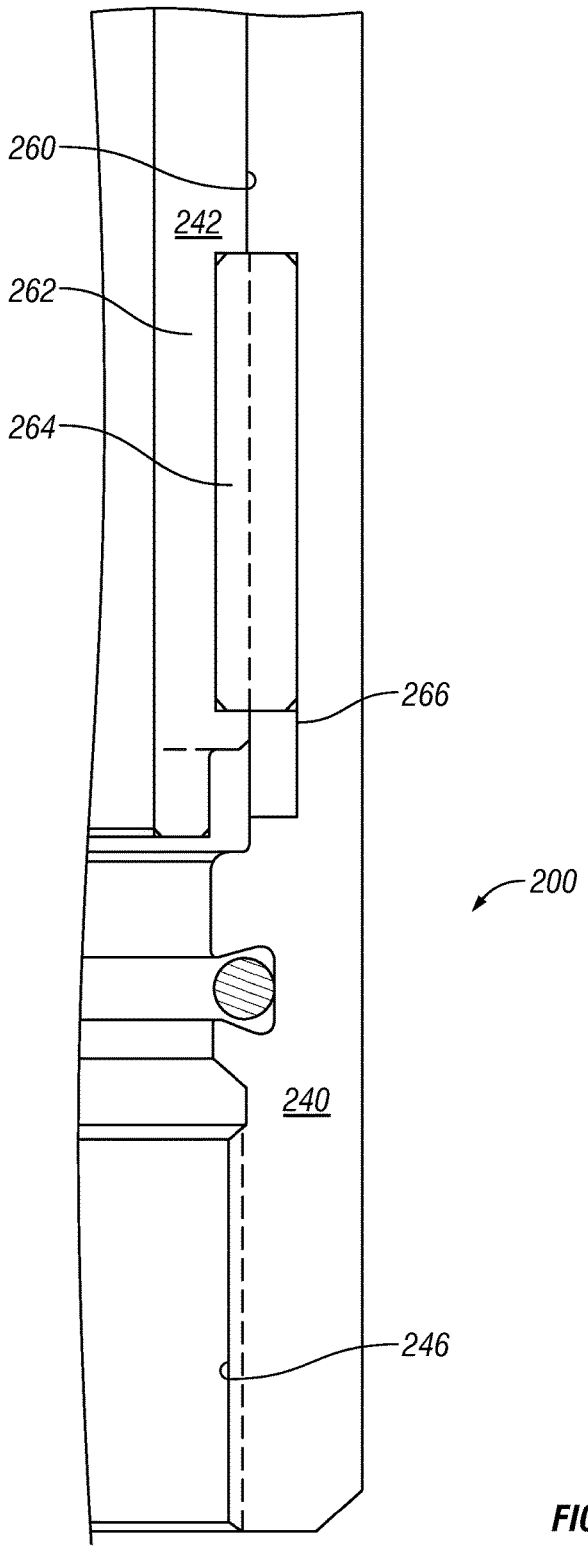
FIG. 6 shows a cross-sectional longitudinal view of a hanger running tool in accordance with one or more embodiments of the present disclosure.

To prevent rotation between the outer sleeve 240 and the inner driving sleeve 242, one or more keys may be engageable with and/or axially movable within a keyway between the outer sleeve 240 and one or more of the segments 262 of the inner driving sleeve 242. For example, as shown in FIGS. 5 and 6, a key 264 may be connected to and/or formed with one or more segments 262 of the inner driving sleeve 242, thereby projecting from the outer surface 260 of the inner driving sleeve 242. Further, the outer sleeve 240 may include a keyway 266 formed on the internal surface 248 of the outer sleeve 240. As such, the key 264 may be engageable with and/or axially movable within the keyway 266, such as movable between the engaged position (e.g., lower position) and the disengaged position (e.g., upper position), as shown.

Figure 7:
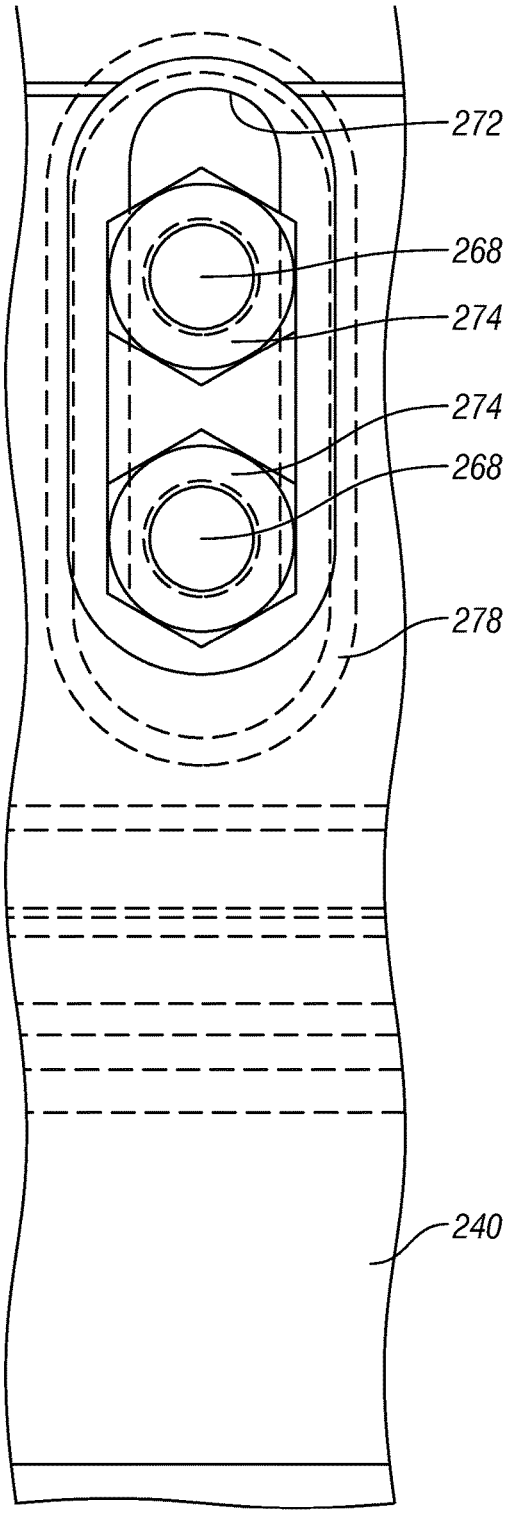
FIG. 7 shows a detailed exterior view of a hanger running tool in accordance with one or more embodiments of the present disclosure.
Figure 8:
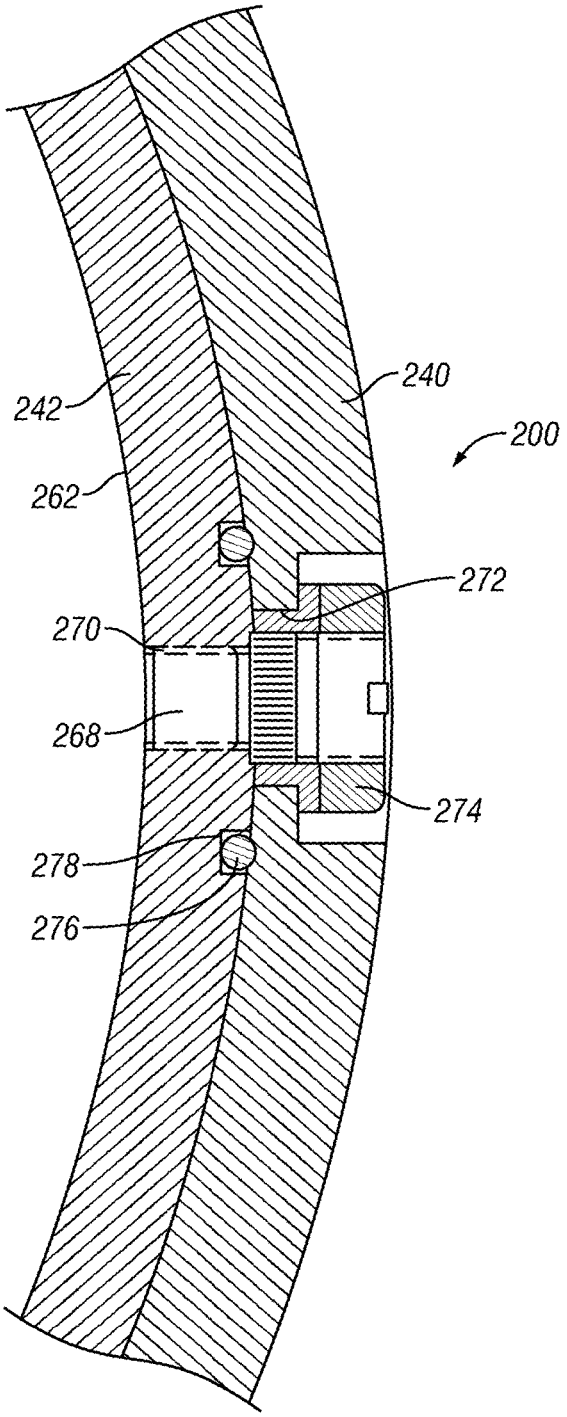
FIG. 8 shows a cross-sectional axial view of a hanger running tool in accordance with one or more embodiments of the present disclosure.

In one or more embodiments, the outer sleeve 240 and the inner driving sleeve 242 may include one or more studs engageable with and axially movable within a slot between the outer sleeve 240 and the inner driving sleeve 242, such as to selectively prevent axial movement of the inner driving sleeve 242 with respect to outer sleeve 240. Further, a securing mechanism, such as a nut, may be used to secure the stud in a relative position within the slot to prevent axial movement of the inner driving sleeve 242 with respect to outer sleeve 240. For example, with respect to FIGS. 3, 7, and 8, one or more studs 268 may be mated, such as threadedly engaged, with holes 270 formed within the inner driving sleeve 242. The studs 268 may then be engageable with and axially movable within a slot 272 formed within the outer sleeve 240, such as movable between the engaged position (e.g., lower position) and the disengaged position (e.g., upper position). A securing mechanism 274, such as a nut, may be used to secure the studs 268 within the slot 272, such that when the stud 268 is secured within the slot 272 by the securing mechanism 274, axial movement of the inner driving sleeve 242 with respect to outer sleeve 240 is prevented. In one or more embodiments, at least stud and slot may be included with each segment of the inner driving sleeve.

In one or more embodiments, the hanger running tool 200 may include one or more seals positioned between the outer sleeve 240 and the inner driving sleeve 242, such as to prevent fluid from passing through the hanger running tool 200 and/or between the outer sleeve 240 and the inner driving sleeve 242. For example, still referring to FIGS. 3, 7, and 8, a seal 276 may be positioned about each slot 272 formed between the outer sleeve 240 and the inner driving sleeve 242 to prevent fluid from passing through the slot 272. In this embodiment, a groove 278 may be formed within the external surface 260 of the inner driving sleeve 242 with a seal 276 positioned within the groove 278. However, those having ordinary skill in the art will appreciate, that additional, or alternative seals, may be used without departing from the scope of the present disclosure.

Figure 9:
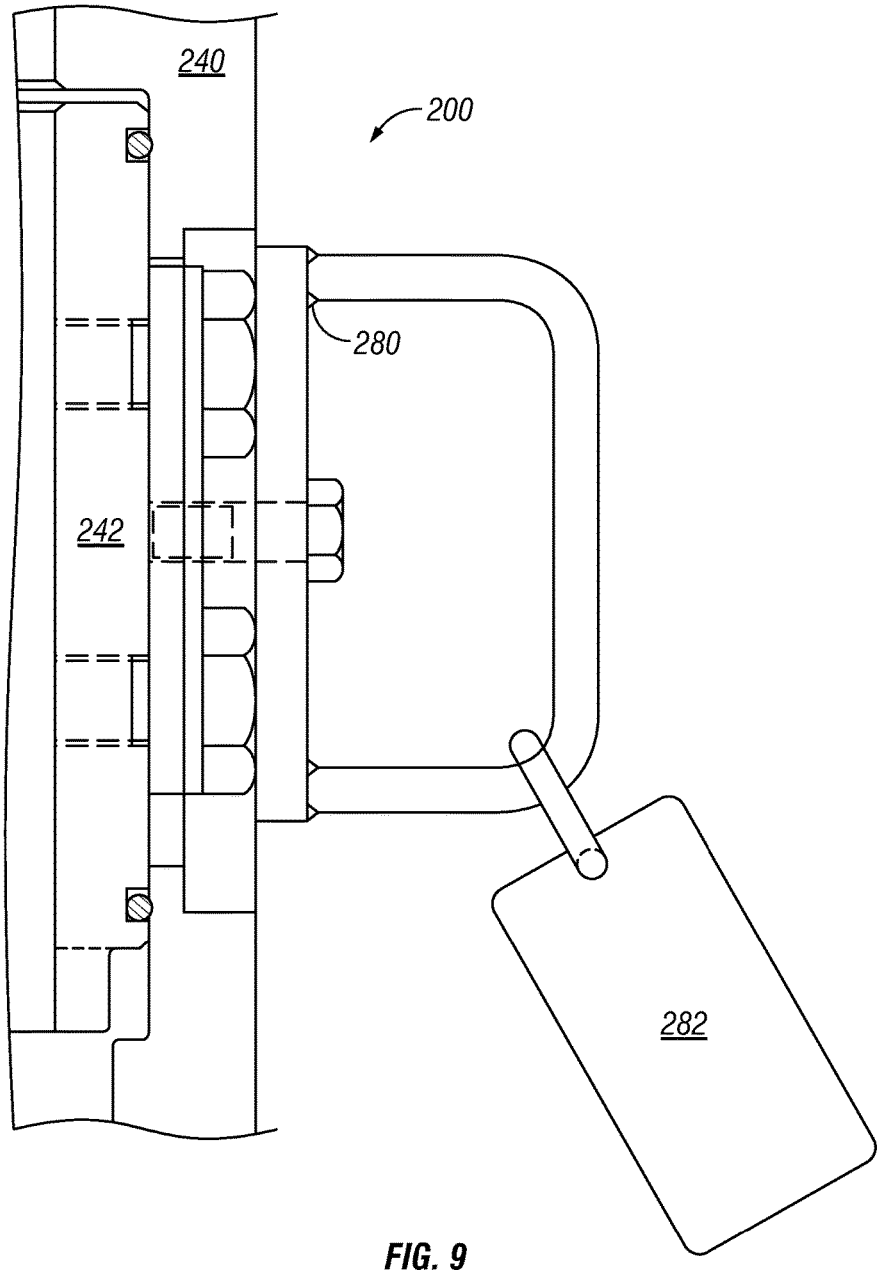
FIG. 9 shows a cross-sectional longitudinal view of a hanger running tool in accordance with one or more embodiments of the present disclosure.

In one or more embodiments, one or more methods or mechanisms may be used to facilitate the connection, set-up, and running of a hanger running tool. For example, as shown in FIG. 9, a handle 280 with a tag 282 may be removably connected to the hanger running tool 200, and more particularly to the outer sleeve 240 of the hanger running tool 200. The tag 282 may have a message, such as to remind a user to set the hanger running tool 200 in an engaged position for use and/or to remind a user of the hanger running tool 200, to secure to secure the studs 268 within the slot 272 with the securing mechanisms 274.

Although the present invention has been described with respect to specific details, it is not intended that such details should be regarded as limitations on the scope of the invention, except to the extent that they are included in the accompanying claims.

What is claimed is:

1. An oilfield tool comprising a hanger running tool for a hanger, the hanger running tool comprising:

an outer sleeve configured to engage the hanger to couple the hanger running tool to the hanger; and an inner driving sleeve selectively axially movable within the outer sleeve and rotationally stationary with respect to the outer sleeve for engagement with the hanger to prevent relative rotation between the hanger running tool and the hanger, wherein the inner driving sleeve is located completely within the outer sleeve.

2. The tool of claim 1, wherein the inner driving sleeve comprises an inner driving sleeve engagement surface comprising a castellated surface, and wherein the outer sleeve comprises an outer sleeve mating surface comprising a threaded surface.

3. The tool of claim 2, further comprising the hanger comprising:

a hanger mating surface comprising a threaded surface corresponding to the threaded surface of the outer sleeve mating surface; and a hanger engagement surface comprising a castellated surface corresponding to the castellated surface of the inner driving sleeve engagement surface.

4. The tool of claim 3, wherein the hanger further comprises a second hanger mating surface configured to mate the hanger with a tubular string, wherein the first hanger mating surface comprises one of a right-hand thread form and a left-hand thread form, and wherein the second hanger mating surface comprises the other of the right-hand thread form and the left-hand thread form.

5. The tool of claim 3, wherein at least one of the castellated surface of the inner driving sleeve engagement surface and the castellated surface of the hanger engagement surface comprises a plurality of castellations, and wherein one side of the plurality of castellations comprises a tapered edge.

6. The tool of claim 3, wherein the inner driving sleeve is axially movable with respect to the outer sleeve between an engaged position and a disengaged position such that, in the engaged position, the inner driving sleeve engagement surface is configured to engage the hanger engagement surface of the hanger to rotate the hanger with the hanger running tool, and in the disengaged position, the inner driving sleeve engagement surface is configured to disengage from the hanger engagement surface of the hanger.

7. The tool of claim 1, wherein the inner driving sleeve is selectively axially movable within the outer sleeve between an engaged position and a disengaged position, the inner driving sleeve engageable with the hanger in the engaged position to prevent relative rotation between the hanger running tool and the hanger.

8. The tool of claim 7, wherein the outer sleeve comprises a groove formed on an inner surface thereof, the inner sleeve being movable within the groove between the engaged position and the disengaged position.

9. The tool of claim 1, wherein the inner driving sleeve comprises a plurality of segments.

10. The tool of claim 9, further comprising a key engageable with and axially movable within a keyway between the outer sleeve and the inner driving sleeve to prevent relative rotation between the inner driving sleeve and the outer sleeve.

11. The tool of claim 1, further comprising a stud engageable with and axially movable within a slot between the outer sleeve and the inner driving sleeve to selectively enable axial movement of the inner driving sleeve with respect to outer sleeve.

12. The tool of claim 11, further comprising a securing mechanism to secure the stud within the slot to selectively enable axial movement of the inner driving sleeve with respect to outer sleeve.

13. The tool of claim 11, further comprising a seal positioned about the slot between the outer sleeve and the inner driving sleeve to prevent fluid from passing through the slot between the outer sleeve and the inner driving sleeve.

14. A system to install a tubular string in a well, the system comprising:

a hanger; and a hanger running tool, comprising:

an outer sleeve configured to engage the hanger to couple the hanger running tool to the hanger; and an inner driving sleeve selectively axially movable within the outer sleeve and rotationally stationary with respect to the outer sleeve for engagement with the hanger to prevent relative rotation between the hanger running tool and the hanger.

15. The system of claim 14, wherein:

the hanger comprises a hanger mating surface and a hanger engagement surface;

the outer sleeve comprises an outer sleeve mating surface configured to mate with the hanger mating surface; and the inner driving sleeve comprises an inner driving sleeve engagement surface configured to engage with the hanger engagement surface.

16. The system of claim 15, wherein the hanger further comprises a second hanger mating surface configured to engage and couple the hanger with the tubular string.

17. The system of claim 16, wherein the first hanger mating surface comprises one of a right-hand thread form and a left-hand thread form, and wherein the second hanger mating surface comprises the other of the right-hand thread form and the left-hand thread form.

18. The system of claim 16, wherein engagement of the hanger engagement surface with the inner driving sleeve engagement surface enables the hanger running tool to rotate the hanger such that the second hanger mating surface of the hanger mates with the tubular string without un-mating the first hanger mating surface with the outer sleeve mating surface.

19. The system of claim 14, wherein engagement of the hanger with the inner driving sleeve enables the hanger running tool to rotate the hanger in a first direction and disables the hanger running tool to rotate the hanger in a second direction.

20. The system of claim 19, wherein:

the hanger comprises a hanger engagement surface comprising a castellated surface;

the inner driving sleeve comprises an inner driving sleeve engagement surface comprising a castellated surface corresponding to the castellated surface of the hanger engagement surface; and one of the castellated surfaces comprises a plurality of castellations with one side of the plurality of castellations comprising a tapered edge.

21. A hanger running tool for a hanger, the hanger running tool comprising:

an outer sleeve configured to threadedly engage the hanger to couple the hanger running tool to the hanger; and an inner driving sleeve selectively axially movable within the outer sleeve and rotationally stationary with respect to the outer sleeve for engagement with the hanger to prevent threaded disengagement between the outer sleeve and the hanger, wherein the inner driving sleeve is located completely within the outer sleeve.

22. The tool of claim 21, wherein the inner driving sleeve is selectively axially movable with respect to the outer sleeve between an engaged position and a disengaged position such that, in the engaged position, an inner driving sleeve engagement surface of the inner driving sleeve is configured to engage a hanger engagement surface of the hanger to rotate the hanger with the hanger running tool, and in the disengaged position, the inner driving sleeve engagement surface is configured to disengage from the hanger engagement surface of the hanger.

* * * * *